United States Patent [19]

Ichihara et al.

[11] Patent Number: 4,659,212

[45] Date of Patent: Apr. 21, 1987

[54] CLEANING APPARATUS

[75] Inventors: Issey Ichihara, Chiba; Toshio Muraoka, Yokohama, both of Japan

[73] Assignee: Kabushiki Kaisha Toshiba, Kawasaki, Japan

[21] Appl. No.: 688,640

[22] Filed: Jan. 3, 1985

[30] Foreign Application Priority Data

Jan. 9, 1984 [JP] Japan ..... 59-1655

[51] Int. Cl.[4] ..... G03G 21/00

[52] U.S. Cl. ..... 355/15; 15/256.51

[58] Field of Search ..... 355/3 R, 15; 15/256.51, 15/256.52

[56] References Cited

U.S. PATENT DOCUMENTS

| | | | |
|---|---|---|---|
| 3,838,472 | 10/1974 | Oriel | 355/15 X |
| 4,181,425 | 1/1980 | Higaya et al. | 355/15 |
| 4,218,132 | 8/1980 | Iwai et al. | 355/15 |
| 4,297,021 | 10/1981 | Tani et al. | 355/15 X |
| 4,456,364 | 6/1984 | Hatzis | 355/3 DD |
| 4,470,694 | 9/1984 | Murakami et al. | 355/15 |
| 4,483,606 | 11/1984 | Kuwako et al. | 355/15 X |
| 4,522,487 | 6/1985 | Misawa | 355/15 |

*Primary Examiner*—Fred L. Braun

*Attorney, Agent, or Firm*—Cushman, Darby & Cushman

[57] ABSTRACT

An electronic photographing apparatus has a cleaning apparatus for cleaning the surface of a photosensitive body. The cleaning apparatus includes a cleaning blade which is set so as to be able to touch and leave the surface of the photosensitive body. The cleaning blade removes the residual toner from the surface of the photosensitive body in the touching condition. The cleaning apparatus also includes a recovery member for collecting the developer removed by the cleaning blade, a casing for temporarily storing the developer collected by the recovery member, and a conveying member disposed opposite to the surface of the photosensitive body and adapted to convey the developer in the casing to a developer container outside the casing. The cleaning apparatus further includes a stirring member extending along the conveying member between the conveying member and the recovery member and adapted to oscillate, rock, and rotate, thereby stirring the developer in the casing.

15 Claims, 9 Drawing Figures

F I G. 5
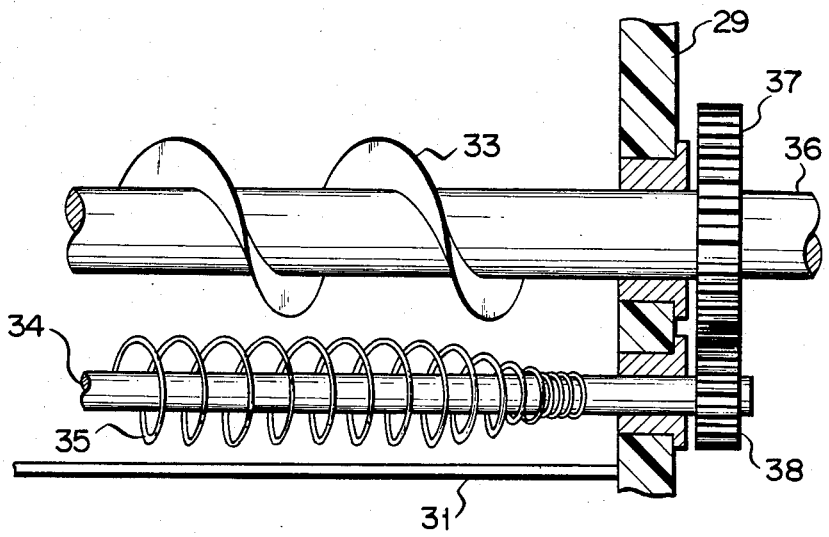
F I G. 7
F I G. 6
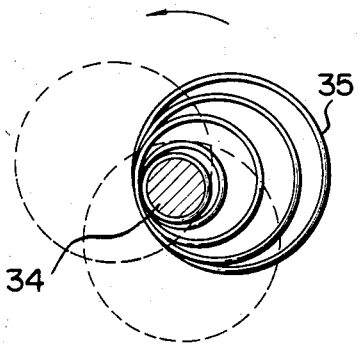
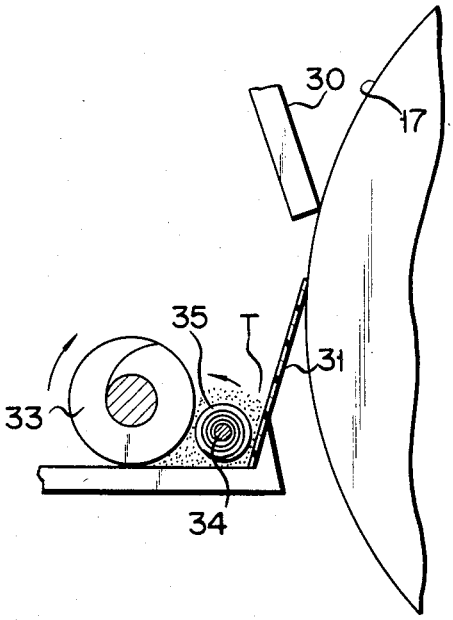

CLEANING APPARATUS

BACKGROUND OF THE INVENTION

1. Field of the Invention

The present invention relates to a cleaning apparatus for cleaning an image bearer used in an image forming apparatus, such as an electronic photograhing apparatus, which develops a latent image on the image bearer by means of a developer. More specifically, the present invention relates to a cleaning apparatus for removing the developer remaining on the image bearer after a transfer operation.

2. Description of the Prior Art

In electronic photographing apparatuses, for example, a toner image formed on the surface of an image bearer (hereinafter referred to also as a photosensitive body) is transferred to the surface of transfer paper, and then deposited and fixed on the transfer paper by a fixing unit. After the transfer of the toner image, a small quantity of toner still remains on the surface of the photosensitive body. The residual toner, which would adversely influence subsequent copying operations, needs to be thoroughly removed from the photosensitive body. In generaly, therefore, electronic photographing apparatuses are provided with a cleaning apparatus for remving the residual toner.

In a prior art cleaning apparatus shown in FIG. 1, residual toner T is scraped from the surface of a photosensitive body 2 by pressing a blade 1 against the photosensitive body surface. Scraped toner T is conveyed along a recovery blade 3 to reach a spiral auger 4 for its recovery. As auger 4 is rotated, toner T is carried into an external toner box (not shown).

When using this type of cleaning apparatus, however, the mobility of toner T may greatly change with variations of circumstances or the like, sometimes causing toner T to accumulate in bulk between recovery blade 3 and sprial auger 4. If the accumulated toner T comes into contact with the surface of photosensitive body 2, as shown in FIG. 1, it slips between blade 1 and photosensitive body 2 when blade 1 leaves photosensitive body 2, thus exerting an adverse influence upon the next copying cycle. In other words, toner T is continually deposited on the surface of photosensitive body 2, so that it will cause filming and various other troubles. Moreover, the accumulated toner T may overflow from both ends of the cleaning apparatus into the electronic photographing apparatus, thereby soiling the interior of the photographing apparatus.

SUMMARY OF THE INVENTION

The present invention is intended to provide a cleaning apparatus capable of preventing a developer from overflowing from both ends of the apparatus or from slipping past a blade to produce black-striped images or to soil a discharge lamp, charger unit or the like, and of preventing an image bearer from being coated with an undesirable film.

BRIEF DESCRIPTION OF THE DRAWINGS

These and other objects and advantages of the invention will become more apparent and more readily appreciated from the following detailed description of the presently preferred exemplary embodiments of the invention taken in conjunction with the accompanying drawings, in which:

FIGS. 2 to 9 shows one embodiment of a cleaning apparatus according to the present invention, in which, FIG. 2 is a side view schematically showing the internal construction of an electronic photographing apparatus incorporating the cleaning apparatus, FIG. 3 is a side sectional view of the cleaning apparatus, FIG. 4 is a front sectional view of the cleaning apparatus, FIG. 5 is a plan sectional view showing a drive system for a stirring member, FIG. 6 is a side view illustrating the behavior of the stirring member, FIG. 7 is a side view illustrating the operation of the cleaning apparatus, FIG. 8 is a plan sectional view showing a first modification of the cleaning apparatus, and FIG. 9 is a plan sectional view showing a second modification of the cleaning apparatus.

DETAILED DESCRIPTION OF THE PRESENTLY PREFERRED EXEMPLARY EMBODIMENTS

One embodiment of a cleaning apparatus according to the present invention applied to an electronic photographing apparatus will now be described in detail with reference to the accompanying drawings of FIGS. 2 to 9.

Figure 2:
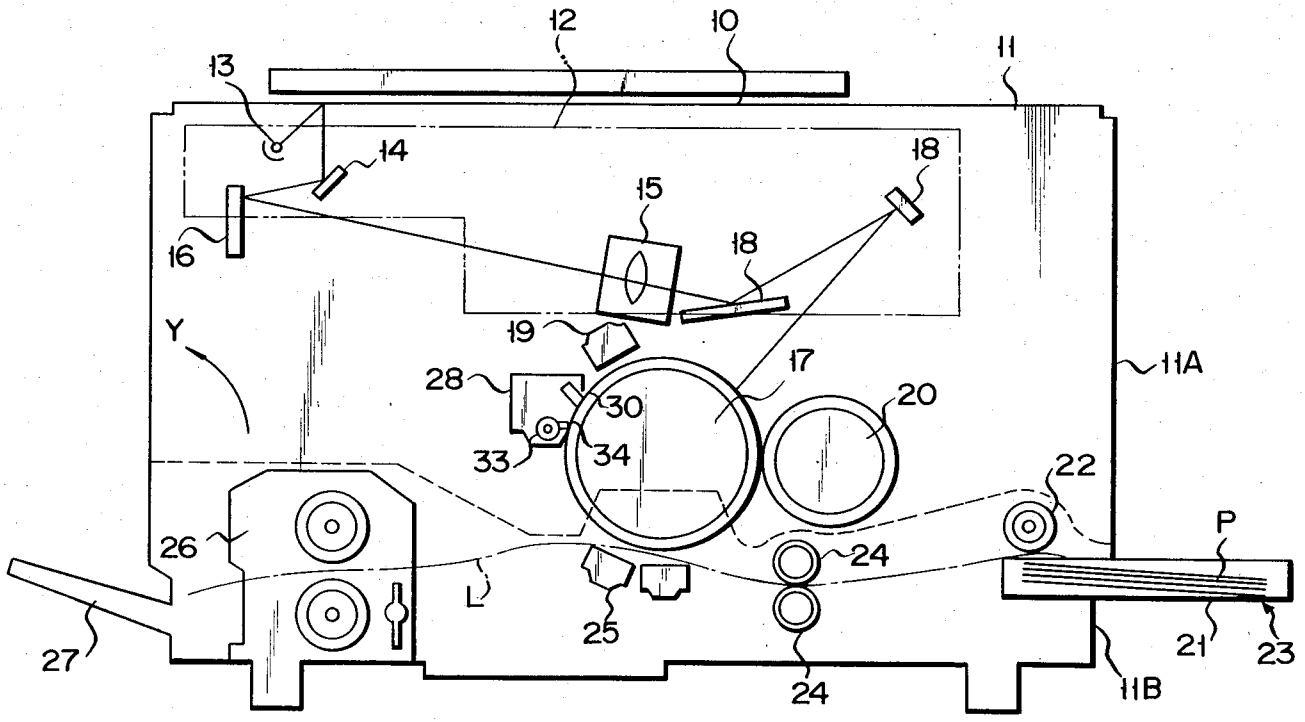

FIG. 2 schematically shows the internal construction of the electronic photographing apparatus to which is applied one embodiment of the cleaning apparatus according to the invention. In FIG. 2, an original table 10 is fixed on the top surface of a housing 11 of the electronic photographing apparatus. An exposure unit 12 is disposed inside apparatus housing 11, located right under original table 10. In exposure unit 12, a lamp 13 and a first mirror 14 move together along original table 10 for optical scanning, progressively lighting the surface of an original on original table 10. A second mirror 16 is disposed in apparatus housing 11 at the left end portion thereof, whereby a reflected light from first mirror 14 is reflected again to be projected on a lens 15. Second mirror 16 is moved so that the length of an optical path extending from the first mirror 14 to the lens 15 is fixed. A series of mirrors 18 is arranged for applying the light transmitted through lens 15 to the surface of a photosensitive body (image bearer) 17 which is disposed substantially in the central portion of apparatus housing 11. Thus, an image of the original projected by lamp 13 is formed on the surface of photosensitive body 17 by exposure unit 12.

A charger unit 19 for charging the surface of photosensitive body 17 is disposed beside photosensitive body 17. The reflected light from the original is projected on the surface of photosensitive body 17 charged by charger unit 19 to form an electrostatic latent image thereon. Toner (developer) is applied to the electrostatic latent image by developing unit 20 to develop the latent image into a visible image. Provided at one side portion of apparatus housing 11 is a paper feeder unit 23 which comprises a cassette 21 storing paper sheets P and a paper-supply roller 22. A sheet P delivered by paper feeder unit 23 abuts against a nip portion between a pair of aligning rollers 24 to be aligned thereby. Thereafter, sheet P is fed into the region between a transfer unit 25 and photosensitive body 17 by aligning rollers 24 in rotation as photosensitive body 17, along with the visible image thereon, rotates. Then, the toner forming the visible image is transferred to the surface of the fed sheet P by transfer unit 25. Thereafter, the toner is fixed on sheet P by a fixing unit 26, and sheet P is discharged into a tray 27 which is provided on the other side of apparatus housing 11.

Cleaning apparatus 28 according to the one embodiment of the present invention is disposed beside photosensitive body 17. Cleaning apparatus 28 is adapted to clean photosensitive body 17 after the transfer operation.

In FIG. 2, a dashed line L represents a sheet conveying path. Apparatus housing 11 is formed of an upper frame 11A and a lower frame 11B, which adjoin each other along conveying path L and are pivotally supported at one end portion. Thus, frames 11A and 11B can be swung open at a desired angle, e.g., 25 degrees, to each other at the other end portion. Upper frame 11A is fitted with photosensitive body 17, cleaning apparatus 28, developing unit 20, and original table 10 to constitute an upper unit. Lower frame 11B is fitted with cassette 21, transfer unit 25, fixing unit 26, and tray 27 to constitute a lower unit. The upper unit can be swung up and down as indicated by arrow y by means of a housing opening unit (not shown), bordered by the sheet conveying path L as a base line. Thus, in case of paper jamming on conveying path L, sheet P can easily be removed after swinging up the upper unit in the direction of arrow y to expose conveying path L.

Figure 1:
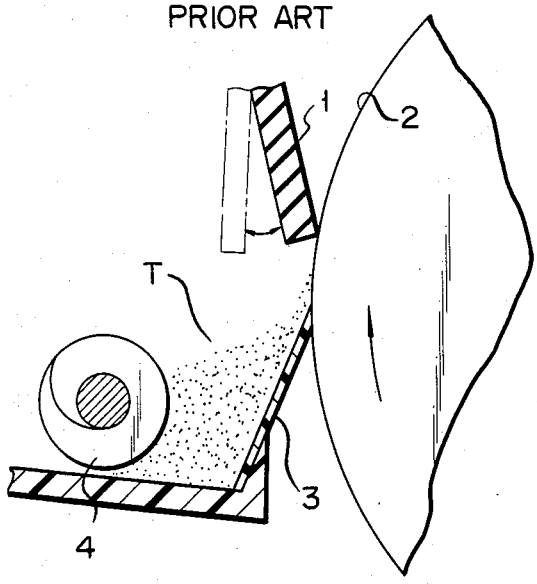
FIG. 1 PRIOR ART
FIG. 1 is a side view showing a prior art cleaning apparatus.
Figure 3:
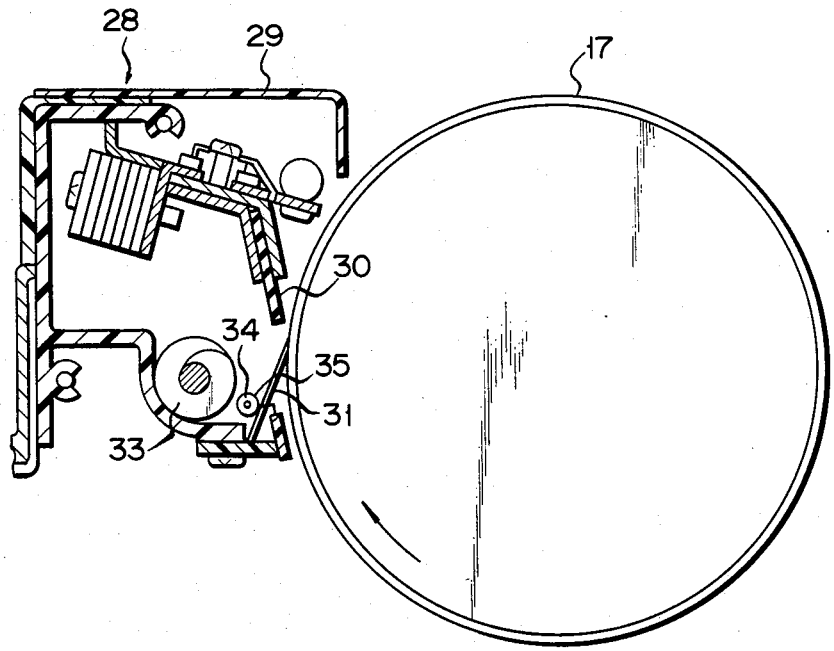

Cleaning apparatus 28 will now be described in detail. As shown in FIG. 3, cleaning apparatus 28 is provided with a casing 29. Inside casing 29, a main blade (cleaning member) 30 for removing residual toner T from the surface of photosensitive body 17 is set so as to be able to touch and leave the surface of photosensitive body 17. In a cleaning mode, main blade 30 is in contact with the surface of photosensitive body 17. In a non-cleaning mode, it is disengaged from the surface of photosensitive body 17. A recovery blade 31 for collecting the toner T removed by main blade 30 and a spiral auger (conveying member) 33 for carrying the collected toner T into a toner box 32 (see FIG. 4) are arranged below main blade 30, extending along the axial direction of photosensitive body 17.

A rotating shaft 34 extends along the axial direction of photosensitive body 17 between recovery blade 31 and auger 33. Rotating shaft 34 is fitted with a sprial stirring member 35, e.g., a coil spring, which rotates and rocks around rotating shaft 34. As shown in FIG. 5, a gear 37 is mounted on that end of a rotating shaft 36 of auger 33 which extends outward from casing 29. Also, a gear 38 is mounted on that end of rotating shaft 34 which extends outward from casing 29. Gears 37 and 38 are in mesh with each other, so that the rotary force of rotating shaft 36 is transmitted through gears 37 and 38 to rotating shaft 34. As rotating shaft 34 is rotated in this manner, stirring member 35 oscillates and rocks.

In particular, each end portion of stirring member 35 at rest is a little smaller in diameter than rotating shaft 34, while its intermediate portion is considerably greater in diameter than rotating shaft 34. Accordingly, stirring member 35 is firmly attached to rotating shaft 34 at both ends, and can oscillate and rock relative to rotating shaft 34 at the intermediate portion. When rotating shaft 34 is not in rotation, the central portion of stirring member 35 comes into contact with the top of rotating shaft 34. Stirring member 35 is attached to rotating shaft 34 by being screwed thereon in the opposite direction to the rotating direction of rotating shaft 34.

When auger 33 rotates, stirring member 35 repeats rotation, rocking motion, and oscillation, as shown in FIG. 6. Namely, as rotating shaft 34 rotates, stirring member 35 mounted thereon also rotates. As mentioned before, the intermediate portion of the stirring member 35 loosely surrounds rotating shaft 34, and its central portion is weighed down. As shaft 34 rotates, therefore, the intermediate portion of stirring member 35 rocks around rotating shaft 34. Moreover, toner will be irregularly distributed among the individual turns of the coil spring which constitutes stirring member 35. Accordingly, the distance (pitch) between each two adjacent turns varies with the rotation of rotating shaft 34, so that stirring member 35 oscillates along the axis of rotating shaft 34. Thus, stirring member 35 is flexible and moves in a complicated fashion, combining rotation, oscillation, and rocking motions.

An accumulation of toner T scraped off from the surface of photosensitive body 17 by main blade 30, as shown in FIG. 7, and collected by recovery blade 31 is leveled by the complicated action of stirring member 35. Then, toner T is delivered to auger 33. Thus, even though the mobility of toner T greatly changes with variations of circumstances or the like, toner T is prevented from accumulating in bulk between recovery blade 31 and auger 33. Accordingly, toner T will neither slip past recovery blade 31 nor overflow casing 29, ensuring production of satisfactory toner images.

Stirring member 35 is formed of a spring material or piano wire. The coil diameter of the intermediate portion of stirring member 35 may be twice to four times as great as the diameter of rotating shaft 34. The pitch of the spring may range from 1 mm to 5 mm, which would lead to the best toner scraping effect.

In the cleaning apparatus as seen from the plan view of FIG. 5, stirring member 35 is sized so that it can rock (as shown in FIG. 6) through substantially the entire space between auger 33 and recovery blade 31, although its periphery is kept from touching members 33 and 31.

Figure 4:
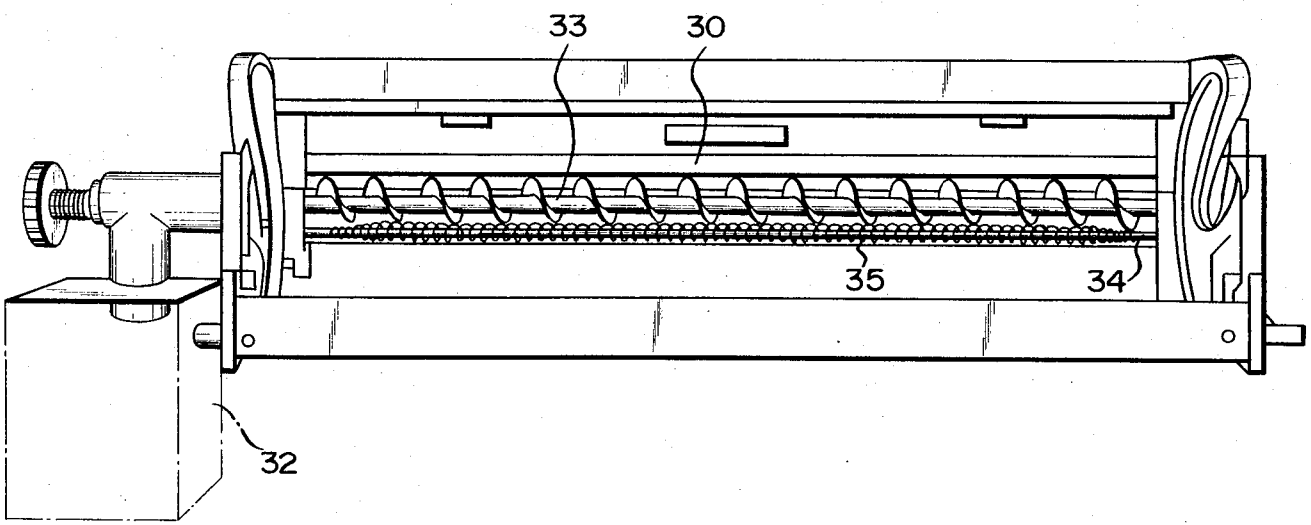
Figure 8:
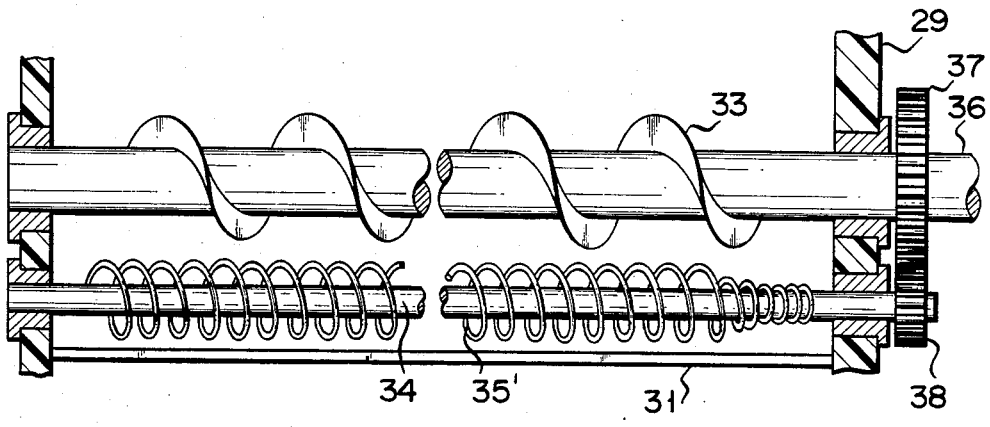
Figure 9:
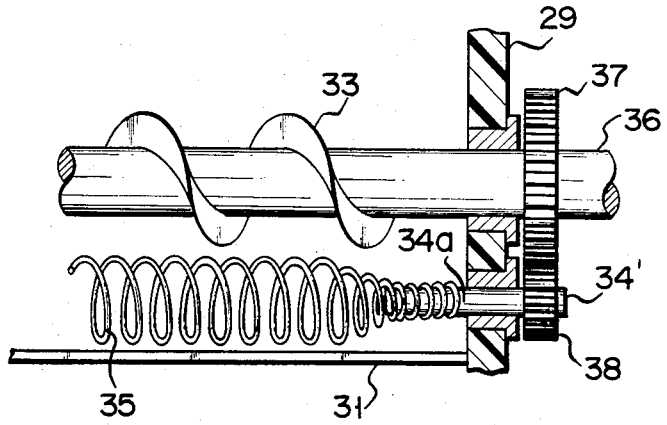

Stirring member 35 also has a toner conveying function. If it is formed of a coil spring, the best toner conveying effect may be obtained when the spring is coiled in a direction opposite to the rotating direction of shaft 34 such that toner T is conveyed in the same direction in which it is carried into toner box 32 by auger 33. By doing this, toner T can be prevented from falling from that end of cleaning apparatus 28 opposite to toner box 32, as shown in FIG. 4. Thus, the interior of the electronic photographing apparatus can securely be prevented from being soiled by toner T.

Although only a single exemplary embodiment of this invention has been described in detail above, those skilled in the art will readily appreciate that many modifications are possible without materially departing from the teachings and advantages of this invention. In the embodiment described above, for example, the cleaning apparatus is applied to the electronic photographing apparatus whose optical system is movable. Alternatively, however, it may be applied to an electronic photographing apparatus whose original table is fixed.

Also in the above embodiment, stirring member 35 is attached to rotating shaft 34 by frictional engagement. Alternatively, however, this may be done by using a suitable fixing means.

In the above embodiment, furthermore, stirring member 35 is mounted on rotating shaft 34 at both ends. As shown in a first modification in FIG. 8, however, stirring member 35' may be mounted only at one end.

In the above embodiment, rotating shaft 34 extends along the entire axis of photosensitive body 17. However, it need not always extend all along the axis, and may be a short projection protruding inward from casing 29, as shown in a second modification in FIG. 9. One end of stirring member 35 is attached to an inwardly projecting end 34*a* of rotating shaft 34'. In this case, the coil diameter of stirring member 35 need to be greater than the diameter of rotating shaft 34, permitting a reduction in dimensional restrictions on members 35 and 34.

Accordingly, all such modifications are intended to be included within the scope of this invention as defined in the following claims.

What is claimed is:

1. A cleaning apparatus for cleaning the surface of a movable image bearer, comprising:

cleaning means, arranged in contact with the surface of the image bearer, for removing developer remaining on the surface as the image bearer moves;

casing means for temporarily storing developer removed by said cleaning means;

means, disposed opposite to the surface of the image bearer, for conveying developer out of said casing means;

a flexible coil spring, extending along said conveying means, for oscillating, rocking and rotating the developer in said casing means to thereby stir the developer in said casing means; and a rotating shaft extending within said flexible coil spring and turning about its own longitudinal axis parallel to said conveying means so as to extend the full length of said casing means, said flexible coil spring being fixed to said rotating shaft only at one end of said flexible coil spring and being rotatable in unison with said rotating shaft, said flexible coil spring having inner peripheral surfaces intermittently contacting the rotating shaft so that the radius of rotation of the flexible coil spring, when rotated, does not exceed a predetermined value.

2. The cleaning apparatus according to claim 1 wherein the coil spring has a pitch ranging from 1 mm to 5 mm.

3. The cleaning apparatus according to claim 1, wherein said conveying means includes a rotatable auger.

4. The cleaning apparatus according to claim 3, further comprising means for rotating the rotating shaft as the auger rotates.

5. The cleaning apparatus according to claim 1, wherein an intermediate portion of the coil spring has a diameter of substantially greater than the diameter of the rotating shaft.

6. The cleaning apparatus according to claim 5 wherein the diameter of the intermediate portion of the coil spring is twice to four times as great as the diameter of the rotating shaft.

7. The cleaning apparatus according to claim 1, wherein the coil spring is coiled in a direction such that the coil spring conveys developer in the same direction as the conveying means conveys developer when the coil spring rotates.

8. The cleaning apparatus according to claim 1, wherein the coil spring is coiled in a direction opposite to the rotating direction of the rotating shaft.

9. The cleaning apparatus according to claim 1, further comprising:

recovery means for collecting developer moved by said spring and said conveying means.

10. A cleaning apparatus for cleaning the surface of a movable image bearer, comprising:

cleaning means, arranged in contact with the surface of the image bearer, for removing developer remaining on the surface as the image bearer moves;

casing means for temporarily storing developer removed by said cleaning means;

means, disposed opposite to the surface of the image bearer, for conveying developer out of said casing means;

a flexible coil spring, extending along said conveying means, for oscillating, rocking and rotating the developer in said casing means to thereby stir the developer in said casing means; and a rotating shaft extending within said flexible coil spring and turning about its own longitudinal axis parallel to said conveying means so as to extend the full length of said casing means, said flexible coil spring being fixed to said shaft only at both ends of said flexible coil spring with an intermediate portion of said flexible coil spring being unattached to said rotating shaft and having a diameter substantially larger than a diameter of said rotating shaft, said flexible coil spring also being rotatable in unison with said rotating shaft so that the radius of rotation of the flexible coil spring, when rotated, does not exceed a predetermined value.

11. The cleaning apparatus according to claim 10, wherein the coil spring has a pitch ranging from 1 mm to 5 mm.

12. The cleaning apparatus according to claim 10, wherein the coil spring is coiled in a direction such that the coil spring conveys developer in the same direction as the conveying means conveys developer when the coil spring rotates.

13. The cleaning apparatus according to claim 10, wherein the coil spring is coiled in a direction opposite to the rotating direction of the rotating shaft.

14. The cleaning apparatus according to claim 10, further comprising:

recovery means for collecting developer moved by said spring and said conveying means.

15. The cleaning apparatus according to claim 10 wherein the diameter of the intermediate portion of the coil spring is twice to four times as great as the diameter of the rotating shaft.

* * * * *